US009921015B1

(12) United States Patent
Roe

(10) Patent No.: US 9,921,015 B1
(45) Date of Patent: Mar. 20, 2018

(54) MAGAZINE CHARGING APPARATUS

(71) Applicant: Richard Darin Roe, Midland, TX (US)

(72) Inventor: Richard Darin Roe, Midland, TX (US)

( * ) Notice: Subject to any disclaimer, the term of this patent is extended or adjusted under 35 U.S.C. 154(b) by 0 days.

(21) Appl. No.: 15/467,605

(22) Filed: Mar. 23, 2017

Related U.S. Application Data

(60) Provisional application No. 62/466,984, filed on Mar. 3, 2017.

(51) Int. Cl.
*F41A 9/82* (2006.01)
*F41A 9/83* (2006.01)
*F41A 9/65* (2006.01)

(52) U.S. Cl.
CPC .. *F41A 9/83* (2013.01); *F41A 9/65* (2013.01)

(58) Field of Classification Search
CPC ..... F41A 9/82; F41A 9/83; F41A 9/84
See application file for complete search history.

(56) References Cited

U.S. PATENT DOCUMENTS 580,176 A * 4/1897 Johnson ..... F41A 9/84 42/88
2,487,040 A * 11/1949 Bilodeau ..... F41A 9/83 294/87.1
2,834,137 A * 5/1958 Kunz ..... F41A 9/83 42/87
3,222,810 A * 12/1965 Musgrave ..... F41A 9/84 42/50
4,538,371 A * 9/1985 Howard ..... F41A 9/84 42/87
2014/0109451 A1* 4/2014 Beckman ..... F41A 9/27 42/1.02
2017/0030670 A1* 2/2017 Kim ..... F41A 9/83

* cited by examiner

*Primary Examiner* — Gabriel J. Klein
(74) *Attorney, Agent, or Firm* — Eldredge Law Firm; Richard G. Eldredge

(57) ABSTRACT

A magazine charging apparatus facilities the storage, transport and transfer of cartridges to a magazine. The apparatus having an interior compartment with channels having prongs that flexible support the cartridges. The end of the apparatus has a tool to facilitate the transfer by pushing the follower of a magazine down and a seating plate that provides a surface to push against the tip of a cartridge forcing it in the magazine. The apparatus could be disposable, recyclable or reusable necessitating various materials in its fabrication.

8 Claims, 7 Drawing Sheets

MAGAZINE CHARGING APPARATUS

BACKGROUND

1. Field of the Invention

The present invention relates generally to ammunition handling systems, and more specifically, to an apparatus to facilitate the charging of a magazine that feeds new cartridges to a firearm.

2. Description of Related Art

Ammunition handling systems are well known in the art and are effective means to store, transport and use ammunition for firearms. For example, FIG. 1 depicts a conventional detachable box magazine 101 having a tube 103 that houses a spring 105 attached to a follower 107. During use, cartridges 109 are placed in the tube 103 by depressing the follower 107.

One of the problems commonly associated with magazine 101 is its limited efficiency. For example, loading the cartridges 109 in the magazine 101 requires the use of both hands to perform this time consuming and tedious task. To load cartridge 109 in the magazine commonly requires multiple attempts due to the round shape of the cartridges that causes the one being loaded to slip off the top of the one previously loaded. This repeated action can cause fatigue and injury. Additionally, the cartridges 109 must be stored prior to being placed in the magazine 101 resulting is packaging waste.

Accordingly, although great strides have been made in the area of detachable box magazines, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
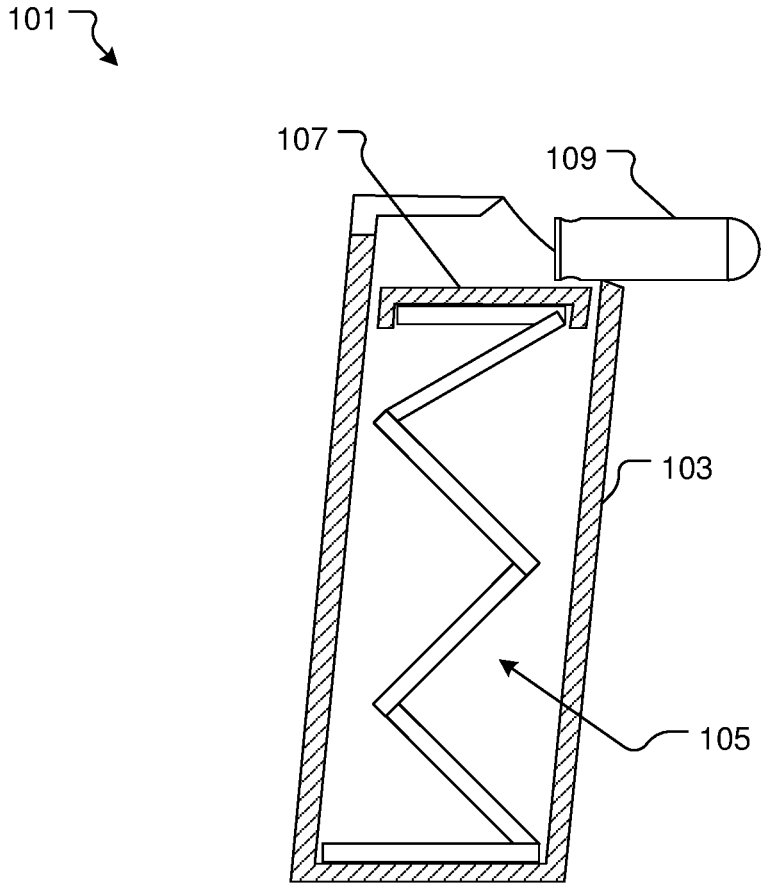
FIG. 1 (Prior Art)
FIG. 1 is a cross-sectional side view of a common detachable box magazine.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional detachable box magazines. Specifically, the apparatus of the present application enables cartridges to be quickly transferred to a magazine. The apparatus facilities the loading of sequential cartridges reducing the effort applied by the user and the discomfort they experience. In addition, the apparatus is used as the packaging for the cartridges prior to being placed in a magazine, reducing the waste created by storing them. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Figure 2:
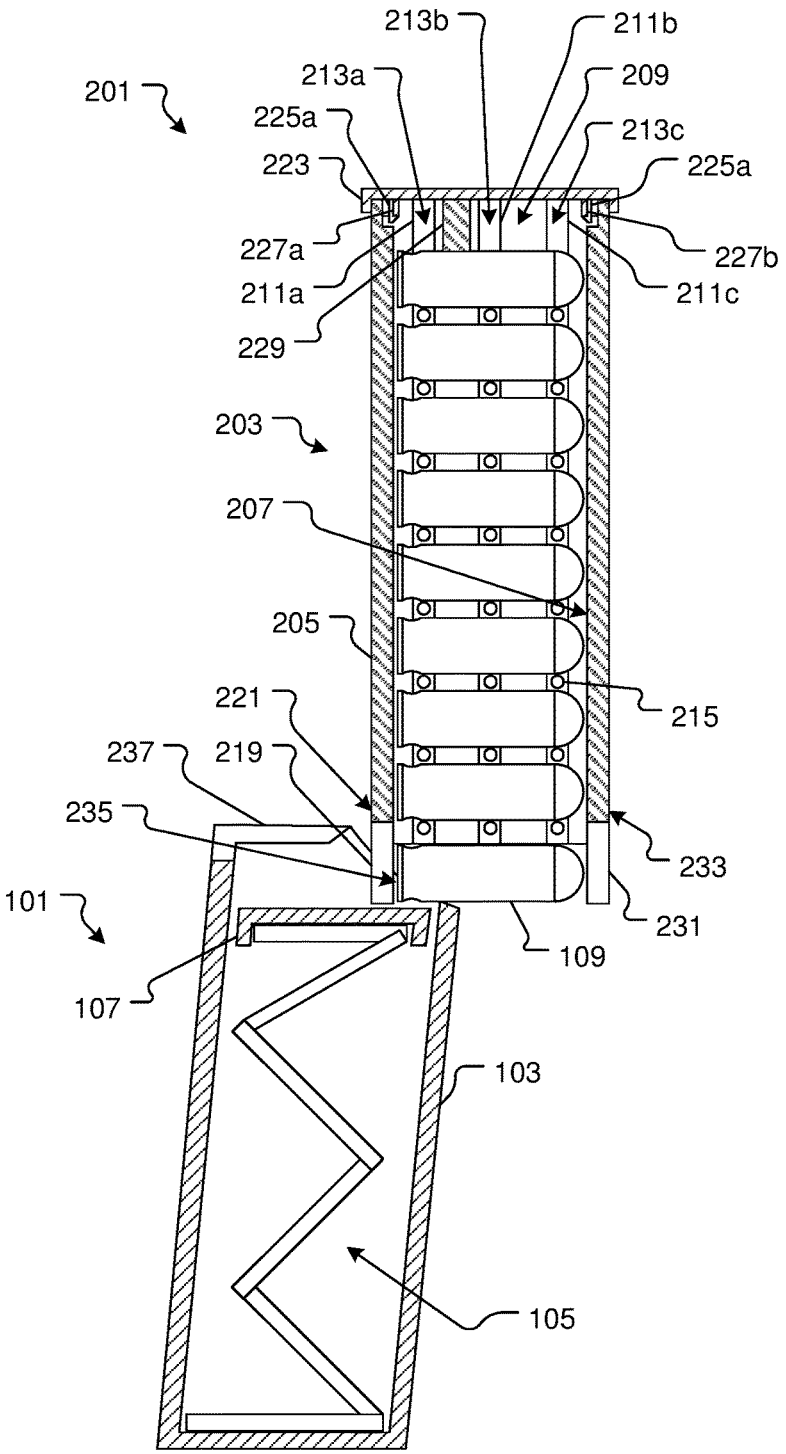
FIG. 2 is a cross-sectional side view of a magazine charging apparatus in accordance with a preferred embodiment of the present application.

Referring now to the drawings wherein like reference characters identify corresponding or similar elements throughout the several views, FIG. 2 depicts a cross-sectional side view of a magazine charging apparatus in accordance with a preferred embodiment of the present application. It will be appreciated that apparatus 201 overcomes one or more of the above-listed problems commonly associated with conventional detachable box magazines.

In the contemplated embodiment, apparatus 201 includes a carrier 203 that holds a plurality of cartridges 109 and facilitates their transfer to a magazine 101.

The carrier 203 having a body 205 that encloses an inner compartment 207 where the cartridges 109 are held. The inner compartment 207 having a first surface 209 with a plurality of channels 211 extending in the body 205 from the surface 209. The channels 211 each having a face 213 generally parallel to the first surface 209, each having a plurality of prongs 215 extending past the first surface 209 into the inner compartment 207. The prongs 215 are configured to so that a series of prongs 215 engage a cartridge 109 simultaneously. As each cartridge 109 is placed in the magazine 101 the prongs 215 allow the remaining cartridges 109 to fall by bending in the channels 211 allowing the cartridges 109 to pass by.

Figure 3:
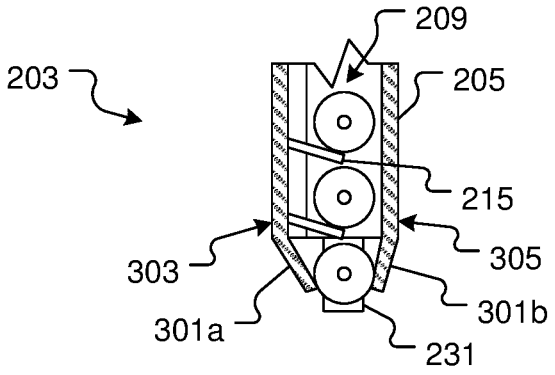
FIG. 3 is a cross-sectional front view of the bottom of the carrier of FIG. 2.

Referring also to FIG. 3 the body 205 having two cradles 301 integral to opposing ends 303, 305. The cradles 301 extend radially towards the center of the inner compartment 207 and keep the cartridges in the inner compartment 207. The body 205 also having a displacement leg 219 rigidly attached to the back end 221 that engages with and pushes the follower 105 down to accept the next cartridge 109. The body 205 having a seating plate 231 extending from the front end 233 that enables the cartridges 109 to be pushed in the magazine 101.

The carrier having a lid 223 permanently attached to the body 205 via a plurality of hooks 225 engaged with slots 227. The lid 223 having a support 229 rigidly attached to prevent movement of the cartridges 109 during transport. It will be appreciated that support 229 could be of various lengths so as to contact the top most cartridge 109. It is also contemplated that the hooks 225 and slots 227 could be located on the exterior of the carrier 203 to allow them to be removed after installation.

Figure 4:
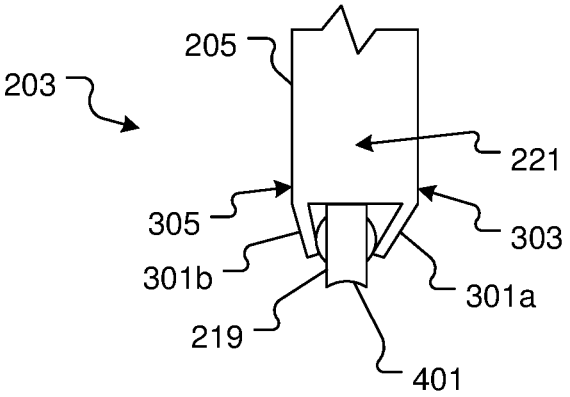
FIG. 4 is a rear view of the bottom of the carrier of FIG. 2.

Referring now to FIG. 4 the displacement leg 219 of the carrier 203 is depicted having a cutout 401 configured to match the contour of the cartridges 109 being used.

In use, the displacement leg 219 of the carrier 203 is placed on the follower 107 of the magazine 101 and is pushed down preparatory to transferring the first cartridge 109. The rear 235 of the cartridge 109 engages with the top 237 of the tube 103 of the magazine 101. The apparatus 201 is partially lifted to release the cartridge 109 from the cradles 301, the seating plate 231 of the body 205 pushes the carrier 203 towards the rear of the magazine 101 completing the transfer of the first cartridge 109. The next cartridge 109 is transferred in similar fashion, except the cut out 401 of the displacement leg 219 engages with the cartridge 109 in the magazine 101 to push the follower 107 and cartridge 109 down.

It should be appreciated that one of the unique features believed characteristic of the present application is that carrier 203 enables the rapid transfer of cartridges 109 to the magazine 101 by integrating the carrier 203 with the tools 219, 301 and 231 that facilitate the process. It will be appreciated that while both hands are still required the process does not slow to retrieve sequential cartridges and that the user does not need to release their grip on the carrier during the transfer.

Another unique feature believed characteristic of the present application is that as the cartridges 109 are transferred to the magazine the prongs 215 of the carrier 203 that facilitate the orderly advancement of the cartridges 109 by preventing them from returning past the prongs 215 once they advance.

It will be appreciated that apparatus 201 could be made of disposable or recyclable materials and replace the packaging that cartridges 109 are normally transported in after manufacture.

Figure 5:
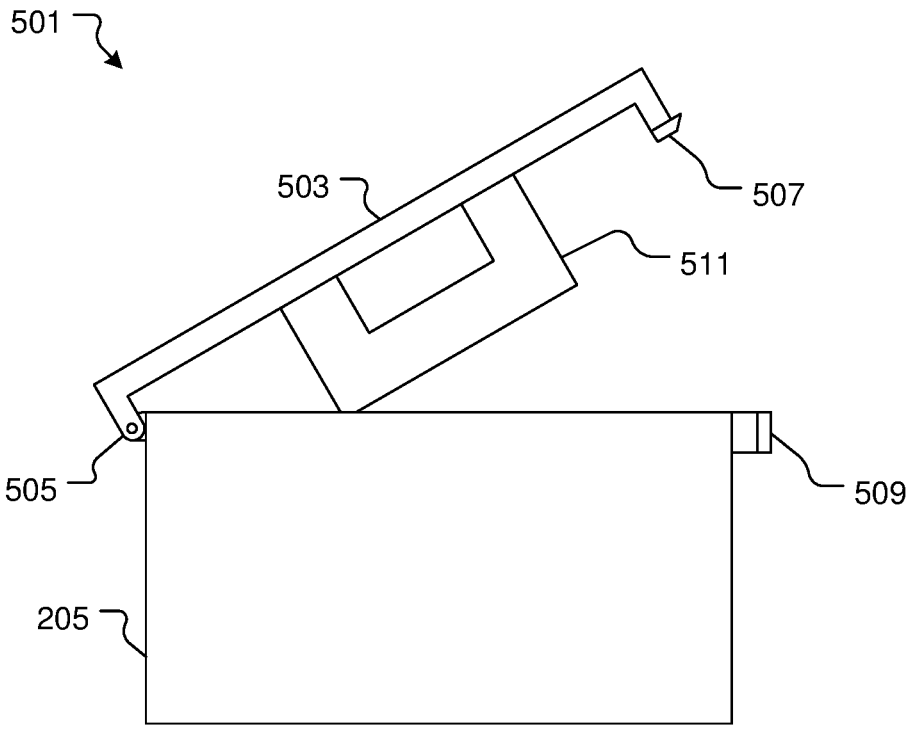
FIG. 5 is a cross-sectional side view of an alternative embodiment of the lid and a carrier of FIG. 2.

Referring now to FIG. 5 an alternative embodiment of the lid 223 of the carrier 203 is depicted. Embodiment 501 including a lid 503 pivotally attached to the carrier 203 via a hinge 505 and latch 507 that attaches via slot 509. It will be appreciated that this embodiment 401 enables the reuse of the apparatus 201. The lid 503 also having a support 511 rigidly attached.

Figure 6:
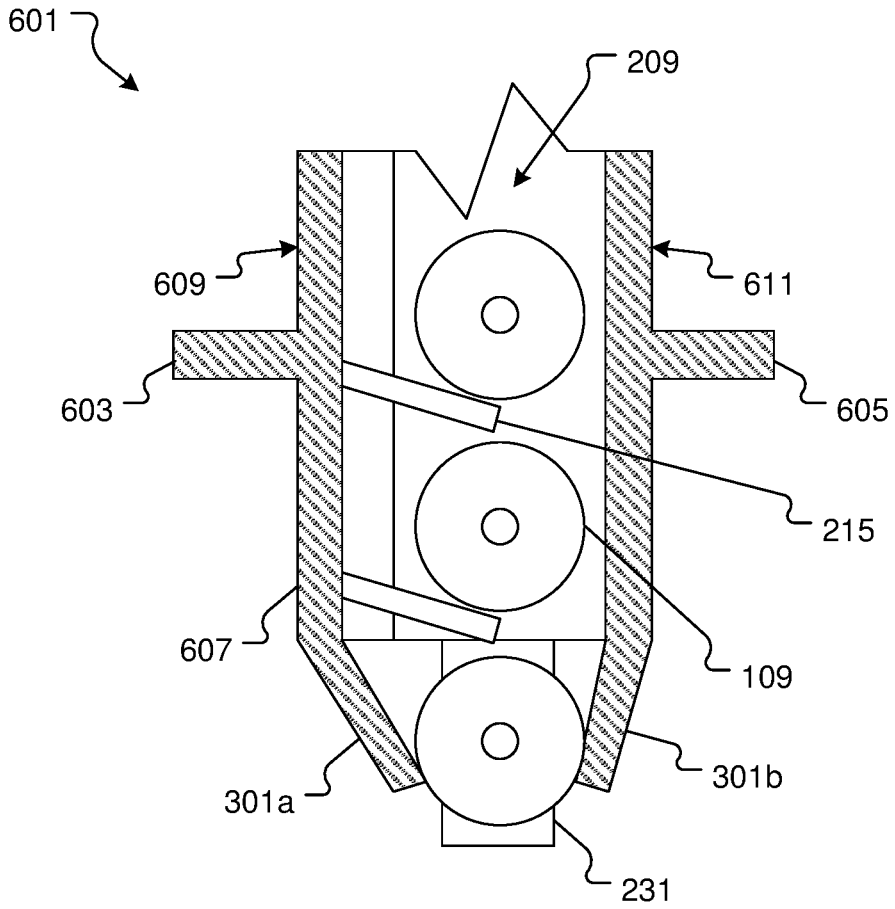
FIG. 6 is a cross-sectional rear view of the carrier of FIG. 2.

Referring now to FIG. 6 an alternative embodiment of the carrier 203 is depicted. The embodiment 601 have the same features as carrier 203 with an additional release handle 603, 605 on rigidly attached to both sides 609, 611 of the carrier body 607.

Figure 7:
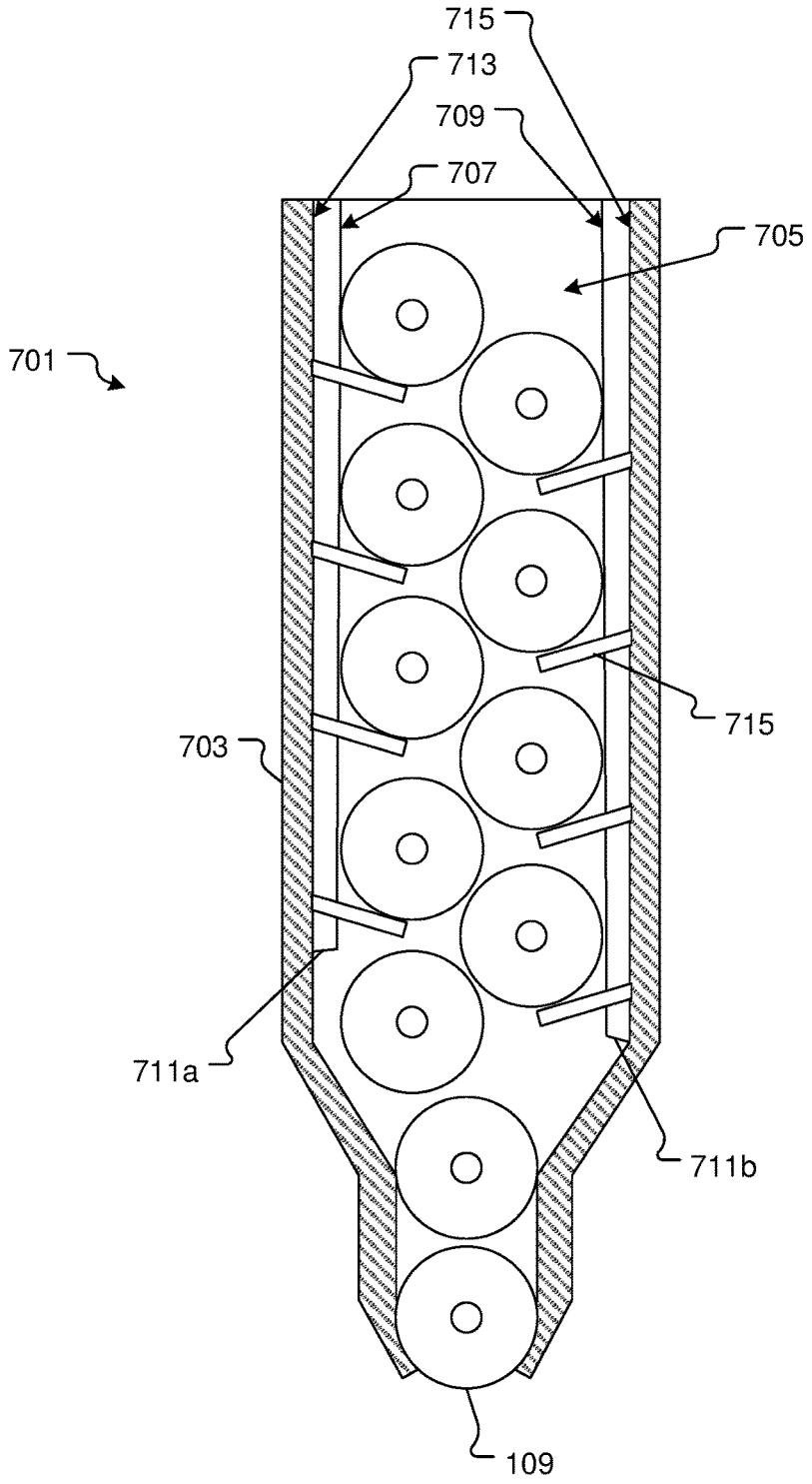
FIG. 7 is cross-sectional rear view of an alternative embodiment of the carrier of FIG. 2.

It is contemplated that the body 205 of carrier 203 could be configured to hold the cartridges 109 in a double stack as shown in FIG. 7 that depicts an alternative embodiment of the carrier 203. Embodiment 701 having a body 703 that encloses an interior compartment 705. The compartment 705 having a first side surface 707 and second side surface 709 with a plurality of channels 711 extending in the body 703 from the surfaces 707 and 709.

The channels 711 each having a face 713, 715 generally parallel to the first surfaces 707, 709, each having a plurality of prongs 717 extending past the surfaces 707, 709 into the inner compartment 705. It will be appreciated that the prongs 717 could have various configurations to facilitate the advancement of the cartridges 109 in the compartment 705.

Figure 8:
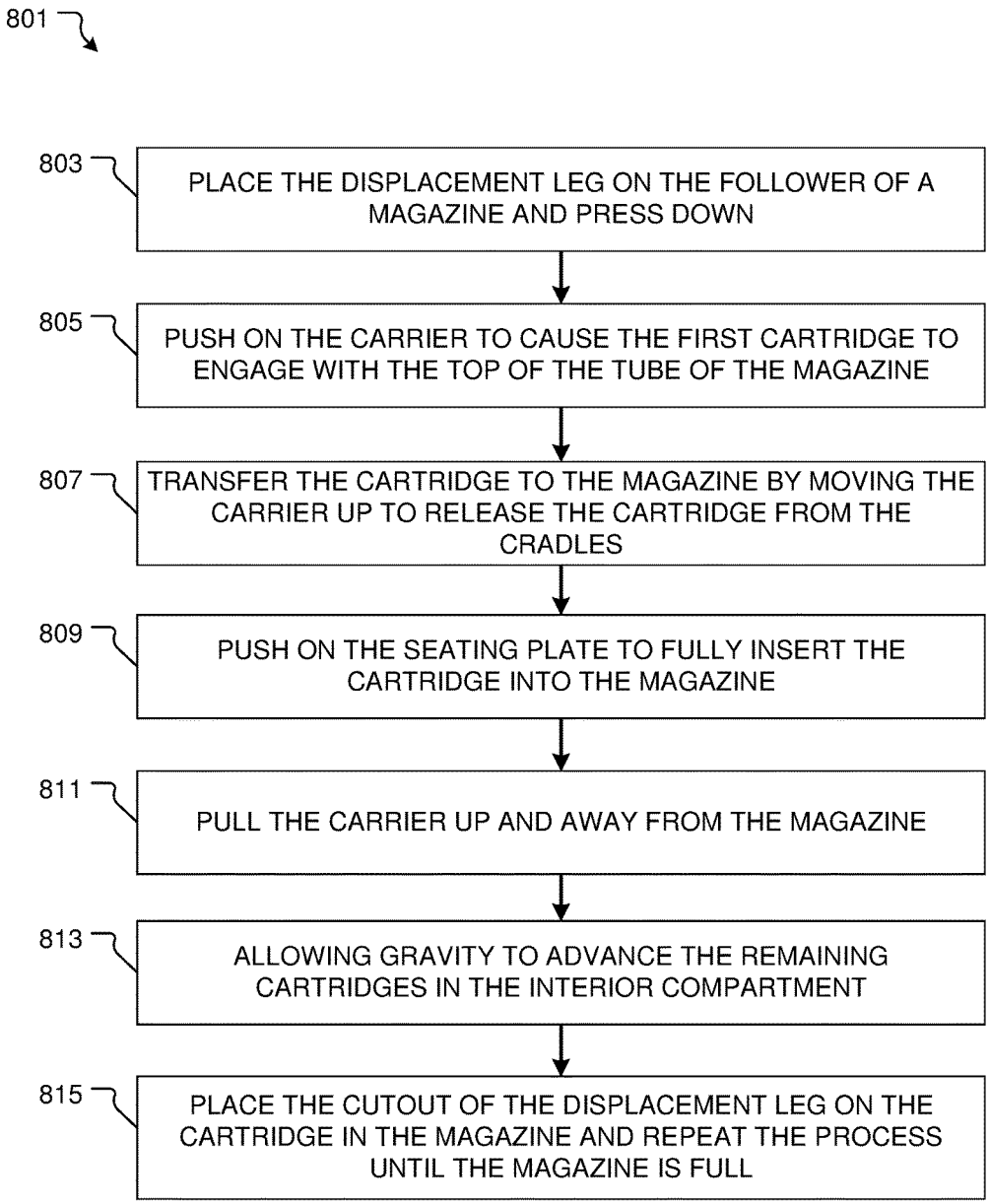
FIG. 8 is a flowchart of the preferred method of use of the apparatus of FIG. 2.

Referring now to FIG. 8 the preferred method of use of the apparatus 201 is depicted. Method 801 including placing the displacement leg on the follower of a magazine and pressing down 803, pushing on the carrier causing the first cartridge to engage with the top of the tube of the magazine 805, transferring the cartridge to the magazine by moving the carrier up to release the cartridge from the cradle 807, pushing on the seating plate to fully insert the cartridge into the magazine 809, pulling the carrier up and away from the magazine 811, allowing gravity to advance the remaining cartridges in the interior compartment 813 and placing the cutout of the displacement leg on cartridge in the magazine and repeating the process until the magazine it full 815.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed:

1. A magazine charging apparatus comprising:

a carrier that holds cartridges and facilitates their transfer to a magazine;

the carrier having:

a body that encloses an interior compartment with a first surface having a plurality of channels that extend in the body from the first surface;

each channel having a plurality of prongs rigidly attached to surfaces of the channels, each of the prongs extending out past the first surface of the interior compartment and engaging with the cartridges and bending towards the channels to allow the cartridges to advance downwardly and to prevent cartridge movement up the compartment;

a lid permanently attached via a plurality of hooks and slots on the interior of the carrier;

a displacement leg rigidly attached on the bottom back end of the carrier configured to depress the follower of a magazine;

one or more cradles integral to at least one side or opposite sides of the bottom of the carrier and extending radially inward to hold a cartridge; and a seating plate rigidly attached to the bottom of the front end of the carrier configured to push the cartridges in the magazine.

2. The apparatus of claim 1 wherein the lid is pivotally attached to the carrier via a hinge and latch.

3. The apparatus of claim 1 wherein the lid is attached to the carrier via hooks and slots on the outside of the carrier.

4. The apparatus of claim 1 wherein the displacement leg comprises a cutout configured to match the contour of the cartridges.

5. The apparatus of claim 1 wherein the body has a release handle rigidly attached to the outside.

6. The apparatus of claim 1, wherein the body is configured to allow for a double stack of cartridges.

7. The apparatus of claim 5 wherein the prongs are offset to facilitate advancement of the cartridges in a double stack configuration.

8. The method of charging a magazine given the apparatus of claim 1 comprising:

placing the displacement leg on the follower of a magazine and pressing down;

pushing on the carrier causing a cartridge to engage with the top of a tube of the magazine;

transferring the cartridge to the magazine by moving the carrier up to release the cartridge from the one or more cradles;

pushing on the seating plate to fully insert the cartridge into the magazine;

pulling the carrier up and away from the magazine;

allowing gravity to advance the remaining cartridges in the interior compartment; and placing the cutout of the displacement leg on the cartridge, now in the magazine, and repeating the process until the magazine is full.

* * * * *